United States Patent [19]

Plesko

[11] 4,210,062

[45] Jul. 1, 1980

[54] AIR CONVERSION FOR INTERNAL COMBUSTION ENGINES

[76] Inventor: Edward J. Plesko, 8362 Ransom Rd., Ashley, Mich. 48806

[21] Appl. No.: 933,870

[22] Filed: Aug. 14, 1978

Related U.S. Application Data

[63] Continuation of Ser. No. 704,397, Jul. 12, 1976, abandoned.

[51] Int. Cl.[2] ..... F01B 29/04

[52] U.S. Cl. ..... 91/54; 91/433; 91/518; 123/DIG. 7

[58] Field of Search ..... 137/472, 475, 509, 510; 60/370, 407, 671; 123/198 C, DIG. 7; 91/52, 54, 421, 454, 433, 518; 417/236, 380

[56] References Cited

U.S. PATENT DOCUMENTS

| | | | |
|---|---|---|---|
| 2,346,829 | 4/1944 | Davis | 91/52 |
| 2,661,023 | 12/1953 | Griswold | 251/28 |
| 3,028,847 | 4/1962 | Sterner | 91/52 |
| 3,885,387 | 5/1975 | Simington | 60/370 |
| 3,963,379 | 6/1976 | Veno | 123/DIG. 7 |
| 3,987,633 | 10/1976 | Ford, Jr. | 60/671 |
| 4,102,130 | 7/1978 | Stricklin | 60/407 |

*Primary Examiner*—Abraham Hershkovitz
*Attorney, Agent, or Firm*—Miller, Morriss and Pappas

[57] ABSTRACT

A valved conversion element for connection to a source of compressed fluid such as air or vapor and to a cylinder in an internal combustion engine. A sensor is provided which communicates with the pressure conditions in the cylinder served so that repetitive power impulses drive the piston in the cylinder as in normal operation of the internal combustion engine. The disclosure contemplates one valved element per cylinder in the engine and that the conversion be achieved by the manifolding of gas, vapor or fluid power to all cylinders through the conversion elements. Each of the conversion units is connected to the cylinders by means replacing the spark plugs of existing engines. Cyclic rate and power are adjustable by valve means controlling the quality and quantity of input fluid, such as air.

6 Claims, 5 Drawing Figures

AIR CONVERSION FOR INTERNAL COMBUSTION ENGINES

This is a continuation, application Ser. No. 704,397, filed July 12, 1976, now abandoned.

The present invention is a device for converting internal combustion engines to vapor or air fluid operation by the relatively simple expedient of attaching a valved conversion structure to each of the cylinders of an internal combustion engine. The organic fluid such as gas, air or vapor admitted under pressure is somewhat analogous to vaporized organic fuel in the normal engine which is expanded to provide the driving force for the pistons.

Having the internal combustion engines, but appreciating that the organic fuels therefor may be in curtailed supply, the present invention contemplates the operation of the internal combustion engines from a compressed fluid such as vapor or gas such as air which can be stored in tanks or other vessels or generators and selectively released as needed. For example, a windmill could convert energy to operate a compressor. The compressor may be connected to a storage tank and the storage tank to the valved conversion devices expressed herein and which valved conversion devices are simply connected to each of the engine cylinders and are themselves attached to the source of compressed fluid such as air. By adjustment of the valved device optimum or selected operation is attained and each valved element is self-timing in relation to the particular cylinder served.

In repair of low horsepower engines in confined shop space, the devices herein described allow the engine to be run without the generation of carbon monoxide as for testing, checking, or running in of new parts or in repairs.

Conversion of internal combustion engines to gas operation hereunder is easily achieved by the utilization of one valved structure per cylinder and by the simple attachment expedient of threading the valved elements into the opening where the spark plugs or glow plugs were formerly inserted.

The Prior Art

So far as is known to the applicant, the closest previous structures are found in the U.S. Pat. No. 3,885,387 to Garnet J. Simington, the U.S. Pat. No. 3,765,180 to Russell R. Brown, the U.S. Pat. No. 3,563,032 to Ralph E. LaPointe; and in the steam conversion of diesel engines in U.S. Pat. No. 2,884,908 of Frank G. Campbell. The prior air operated structures are highly complex devices requiring involved gas or power distribution systems for timing and the like. As will be seen, the devices of applicant are extremely simple and the sequence or timing problem is automatically solved by the sensor aspect of the valved device, each connected to a separate cylinder and supplied with power from a common source.

Accordingly, the principal object is to provide a compact and simple conversion element for interposing between the cylinders of internal combustion engines and a source of compressed fluid to convert operation from an organic fuel to a pressurized fluid such as gas, air or vapor.

Another object is to provide a conversion structure of the type indicated which is self-timing in the sequence of supply of compressed gas to a cylinder.

Another object is to teach a simple conversion in which a conversion valve assembly is directly connected to each cylinder at the spark plug or glow plug opening.

Another object is to provide a structure which economizes by saving the gas pressure at or approximating the use load.

Other objects including simplicity of control and economy of manufacture of the conversion units will be appreciated as those skilled in the art review the description and drawings.

In the Drawings

General Description

Figure 1:
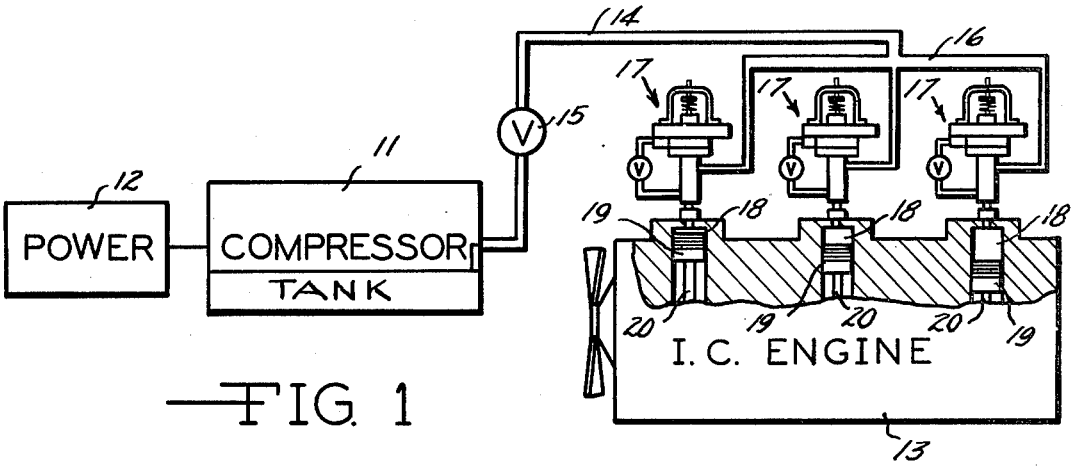
FIG. 1 is a side elevation view in a somewhat schematic form indicating an internal combustion engine which has been converted to compressed fluid operation using compressed air in accord with the present invention and connected to a source of compressed air.

In general, the present invention is a valved conversion head or element in which a sensor automatically times the delivery of compressed fluid or gas to each cylinder served. The sensed condition is the pressure condition inside of the engine cylinder and the pneumatic valve drive mechanism is that of a differential pressure system such as a lineal actuator in which the pressure setting is adjustable. A throttle valve is adjustable in a by-pass like sensing line to the sensor valve. A master throttle valve is in the compressed fluid line. The conversion unit includes a portion which is connectable to the cylinder above the piston and which is preferably threaded into the opening occupied previously by the firing element (glow plug or spark plug) of the internal combustion engine cylinder. An adjustable vent valve in the sensor line allows selected venting to atmosphere and consequent local reduction of pressure. Plural of the conversion valve elements are useable together, one on each cylinder in substitution for the plugs in the internal combustion engines served. The conversion units are connected to a source of compressed fluid such as air and the conversion units control the frequency and input of gas to the cylinder. Physically, the upward movement of the piston in the cylinder to preignition pressure (compression stroke) causes the elevation of the valve stem in the conversion unit and permits the introduction of the line pressure to achieve the compression stroke to exhaust. The speed of the piston under compression is a function of the line pressure. Since the line flow and pressure can be throttled, then a speed control is available in the conversion unit. The timing is thus automatic and the sensitivity of the closure of the principal valve is adjustable. Since each piston sequences in accord with its mechanical linkage, the timing in each conversion unit is automatic.

Since the admission valve opens at ignition pressure in the cylinder, the gas utilized in the compression is volumetrically minimized and pressure economy is also realized.

A differential pressure actuator such as a diaphragm actuator is exposed on one side to atmospheric pressure plug spring pressure and on the other side to the pressure available from the cylinder via a by-pass or sensor line. A valve stem is connected to the differential pressure linear actuator structure and moves with it under an adjusting bias. A drive valve is actuated by the linear actuator to open and close flow through the conversion unit. Line pressure gas supply enters the body of the conversion valve unit but is prevented from reaching the cylinder of the internal combustion engine served because the linear actuator, working on the stem, seats the drive valve and prevents fluid flow through the valve bo until the linear actuator senses the compression surge of the piston in the engine. At that point the valve stem is moved by the diaphragm actuator and line pressure is applied to the cylinder and piston to drive the piston downwardly in the power stroke. The working pressure vents to atmosphere at the bottom of the piston stroke and the piston rises again to the compression ignition peak. This peak is sensed by the present structure. The drive valve is opened and the cycle repeats. In four and two cycle engines, the conversion devices work beautifully with the trip threshold being adjustable by the spring pressure on the valve stem and the speed adjustable by a throttle valve in the compressed fluid or air line. A valve in the by-pass allows orificial modulation of flow to the differentially actuated linear actuator (high pressure side of diaphragm) and a line vent to atmosphere is available for further attenuation, as needed, to reduce (for example) high compression conditions.

The actual conversion unit is described as an in-line structure but may be modified as by compaction and integration of the elements and by locating the actuator body remote from the extension from the opening into the cylinder so long as the communicating passages and the relative flow, valve, and control elements function as described. For example, the control unit may have a single shortened body or housing in which the by-pass is a channel or opening in the valve body and the valve body may be L-shaped to suit clearance relationships. Similarly a concentric passage in the barrel or body may provide high pressure access to the differential valve such as the diaphragm actuator. The unit illustrated allows easy dismantling and access to parts for testing and performance evaluation. However, those skilled in the art will perceive means of simplification and obvious analogous substitutions and integration for convenience in use and manufacture.

Specific Description

Referring to the drawings and with first particularity to the FIG. 1 thereof, a compressor 11 is operably connected to a source of power 12 such as (but not limited to) a turbine motor or a windmill. The compressor 11 may directly serve the internal combustion engine 13 with compressed fluid such as gas, vapor or air and through the conducting tubes or lines 14. In some instances storage tanks are desirable in which compressed gas under desired operating pressure is stored for delivery to the lines 14. In some instances the compressor 11 has integral tank capacity as shown. A throttle valve 15 is provided in line 14 to the internal combustion engine 13. As illustrated, a manifold 16 provides for equalized distribution of compressed gas to the conversion units 17. The conversion units 17 are each connected to the cylinders 18 of the internal combustion engine 13. This communicates the compressed gas through the conversion units 17 and into the cylinders 18 to power the pistons 19 thereof. The pistons are operably connected to the connecting arms 20 and the connecting arms 20 are connected to a crankshaft (not shown) as is well known in the reciprocating type of internal combustion engines. As the pistons 19 reciprocate in the cylinders 18, they are translating the driving energy into rotary motion. The timing in each piston 19 is different so that while one cylinder is powering, others are using a part of that power to maintain a return. When spark or glow plugs are in the cylinders 18, the fossil or organic fuel normally used in internal combustion engines is fired at the peak of the piston 19. This compression phenomena is used to automatically introduce and time the entry of compressed gas and the high pressure of the compressed gas is an economizing step since only the driving gas at displacement volume and operating pressure need be supplied to each cylinder 18. At the drop in pressure on completion of the power stroke, for example, the conversion units 17 automatically close off the compressed gas until the high pressure condition in the cylinders 18 is restored. This aspect of the invention permits the use of the conversion units 17 in either two or four cycle engines and while never applied yet to Diesel and Rankin cycle engines, it is predictable that the units 17 would work also in that use environment.

Figure 2:
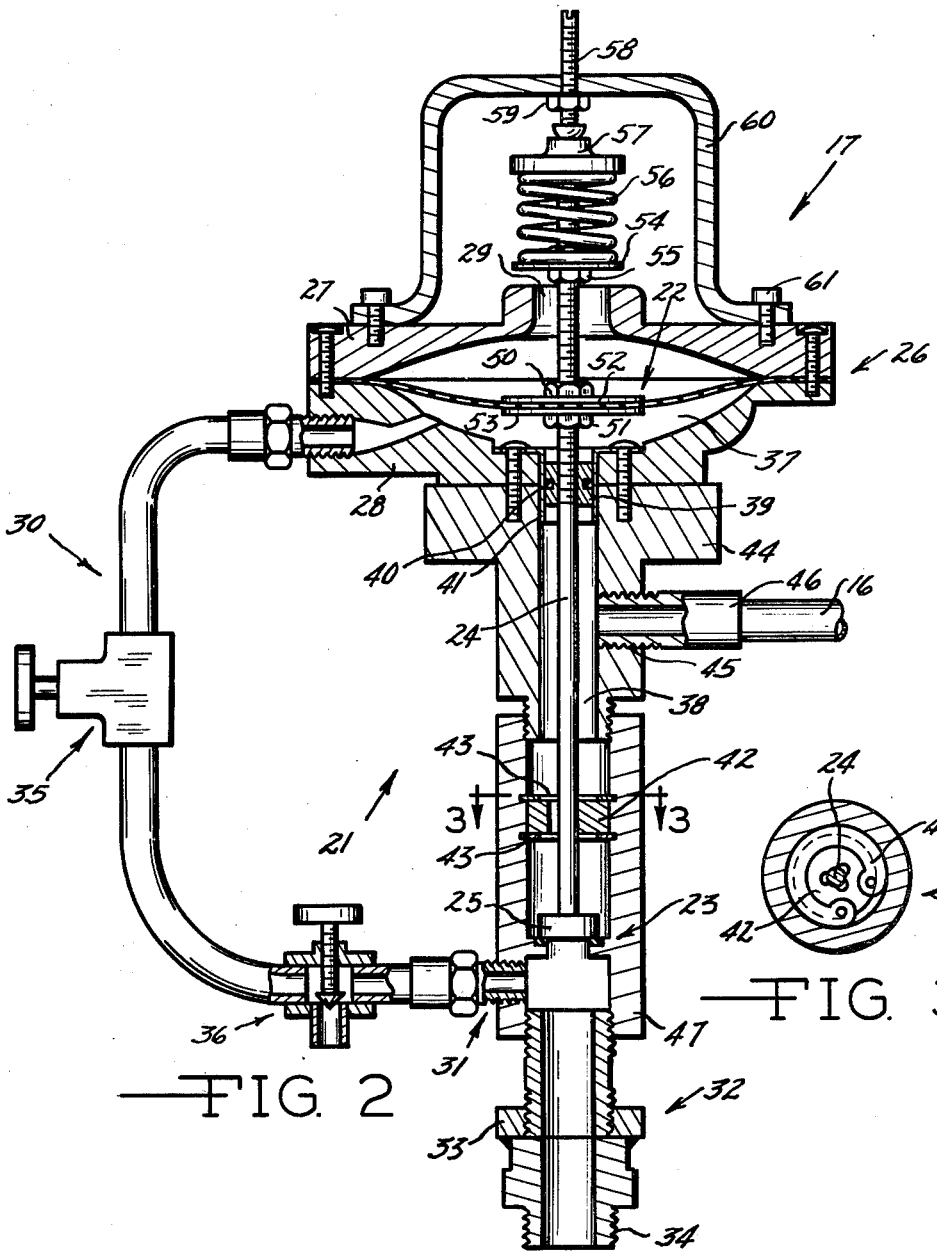
FIG. 2 is a side elevation view of one of the conversion valve units seen in FIG. 1 and in full section on the axis of the body or barrel to reveal the basic simplicity of the conversion structure.

In FIG. 2 a full cross section is taken through the axis of the valve body or barrel 21 in the conversion unit 17 and the structure simplicity and function of the conversion unit 17 will be best appreciated. The conversion unit 17 is connected to the source of high pressure through line 16. The gas under pressure moves through the line 14 and into the valve body 21 between the diaphragm 22 and the valve seat 23 thereof at the end of the stem 24 when the valve 25 is closed on the seat 23, as shown. The diaphragm body or support 26 is in two parts 27 and 28, the body part 27 being vented to atmosphere at opening 29 and the body part 28 being connected to the by-pass 30. The by-pass 30 is connected to the valve body 21 below the valve seat 23 of the diaphragm element 22 and on the cylinder side of the conversion unit 17 at entry 31 and thus provides means to sense the pressure condition at the cylinder. A tubular connector or adaptor 32 having wrench shoulders 33 (like a spark plug) and depending male threaded extension 34 is in communication with the body 21 and provides means for connecting the unit 17 to the cylinders 18 (FIG. 1) in the opening where the spark plug or glow plug are usually found. Adjusting valves 35 and 36 are provided in the by-pass 30. The valve 35 is a shut-off valve exercising control over flow of gas from by-pass 30 to the diaphragm cavity 37 defined between the diaphragm 22 and the diaphragm body portion 28. The valve 36 is a bleeder vent valve allowing the selected venting of gas in the by-pass 30 to atmosphere. A typical vent valve is the needle valve as schematically shown for attenuating pressure to the diaphragm 22.

The diaphragm 22 is connected operably to a stem piece 24 and valve 25 on one side to close on the seat 23 in the body 21 as shown. The stem 24 is guideably movable in the body cavity 38 by means of the piston packing element 39 which reciprocates with the valve 25 while preventing gas from line 16 entering the high pressure side of the diaphragm in cavity 37. An O-ring 40 is a preferred form of seal running in the flanged tubular liner 41. Supplemental lineal bearings and guides 42 are secured in the cavity 38 as by snap rings or retainers 43 in grooves 44. Gaps assure the maintenance of gas communication in all parts of the cavity 38 with light journal control over the stem 24. This journalling is desirable depending upon the length of the stem 24 and specific design of the body or encasement 21. As seen, the body 21 is a tubular structure defined around the cavity 38 and communicating as described with the cavity 37 of the diaphragm 22 and the nipple or tubular connector 32. For convenience in fabrication, the body 21 having a transverse opening 45 includes a tubular fitting or nipple 46 and is connected to the high pressure inlet line 16. A sleeve 47 threaded at both ends internally is threadably connected at the upper end (as seen in FIG. 2) to the fitting 44 and threaded at the bottom end to the connector tube 32. Intermediate the ends of the sleeve 47 is the valve seat 23 upon which the stem mounted valve 25 rests until lifted therefrom. As previously described, journal means 42 may be included in the body 21 as best appreciated in the FIG. 3 and retained in place by snap rings 43.

Those skilled in the art will appreciate that elements 28, 44, 47 and 32 could be integrated in a single casting and could include the by-pass 30 (for example, concentric about the cavity 38) and the parts as otherwise required for valving and flow connections could be located in operative respect thereto.

The diaphragm 22 is sandwiched between the upper and lower diaphragm elements 27 and 28 and the stem 24 with piston packing 39 is dropped axially into the cavity 38 guided to appropriate seating at seat 23. The upper end of the stem 24 may be threaded for attachment of the piston seal 39 and for securing to the center of the diaphragm 22 as by nuts 50 and 51 pressing the washers 52 and 53 into holding and sealing relation on the diaphragm 22 at the center thereof. The threaded extension of the stem 24 provides adjustable mounting means for the thrust platform 54 retained in place by nuts 55. The platform 54 supports the compression spring 56 and the spring 56 bears on the press plate 57 which allows the compression on the spring 56 to be easily adjusted by the axial repositioning of the pressure plate 57. This is achieved by the screw 58 and jam nut 59 which axially allows the screw 58 to adjustably engage the pressure plate 57. As shown, the nut 59 transmits axial stress into the bonnet 60 which forms an open-work super-structure over the diaphragm body element 27 and is attached thereto as by cap screws 61.

Figure 4:
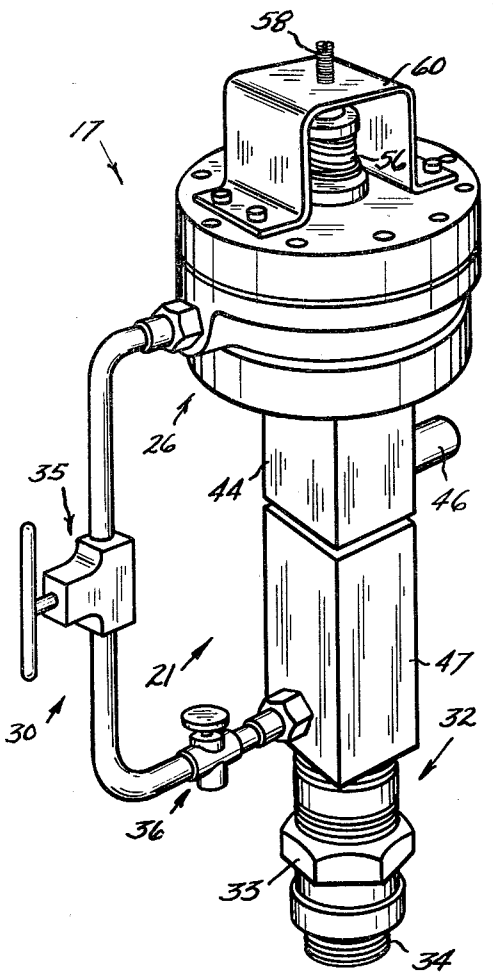
FIG. 4 is a perspective view of one of the conversion valve units ready to be installed in the threaded opening where a spark plug formerly was seated.

In FIG. 4 the fully assembled structure of the conversion unit 17 is shown ready for insertion in the spark plug or glow plug openings of each cylinder in internal combustion engines. As set out in FIG. 1, the plugs are removed and the assembly as illustrated in FIG. 4 is screwed into the plug opening at the fitting 34 and connected to a source of pressurized gas at the nipple 46. A throttle valve 15 (FIG. 1) exercises control over the input gas, for example, compressed air. Valves 35 and 36 in the by-pass 30 adjust sensed internal cylinder pressure to the lower side (high pressure side) of the diaphragm valve 26. When the cylinder pressure exceeds the ambient pressure plus the spring pressure of spring 56 in holding the valve 25 on the seat 23 (FIG. 2), then the stem 24 is lifted opening the valve 25 and allows line pressure from entry 46 to enter the cylinders 18 and drive the pistons 19. When the pressure in cylinder 18 drops by completion of the power stroke, then the pressure of spring 56, the atmosphere and the line pressure on the valve elements closes the valve 25 on seat 23 until the piston 19 compresses the gas in the cylinder 18 to a pressure feeding through the by-pass 30 to the diaphragm 22 to lift the stem 24. Hence, the valve element 26 functions as a sensor and adjusts to provide automatic timing to the speed of the piston. This self-timing feature applied to each cylinder makes installation and use of the invention simple. The valving in the structure 26 is readily appreciated as a differential pressure valving system. Adjustment of speed is by the throttle valve 15 and performance is attenuated by the valves 35 and 36. The valve 35 throttles flow through the by-pass and the valve 36 may allow venting where the sensitivity of the sensor system needs reduction.

Figure 3:
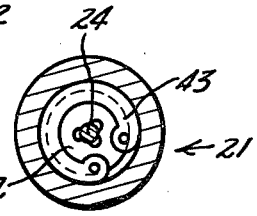
FIG. 3 is a full section view taken on the line 3—3 of FIG. 2 and indicating the lineal journalling of the rod or valve stem while permitting flow through the journal means.
Figure 5:
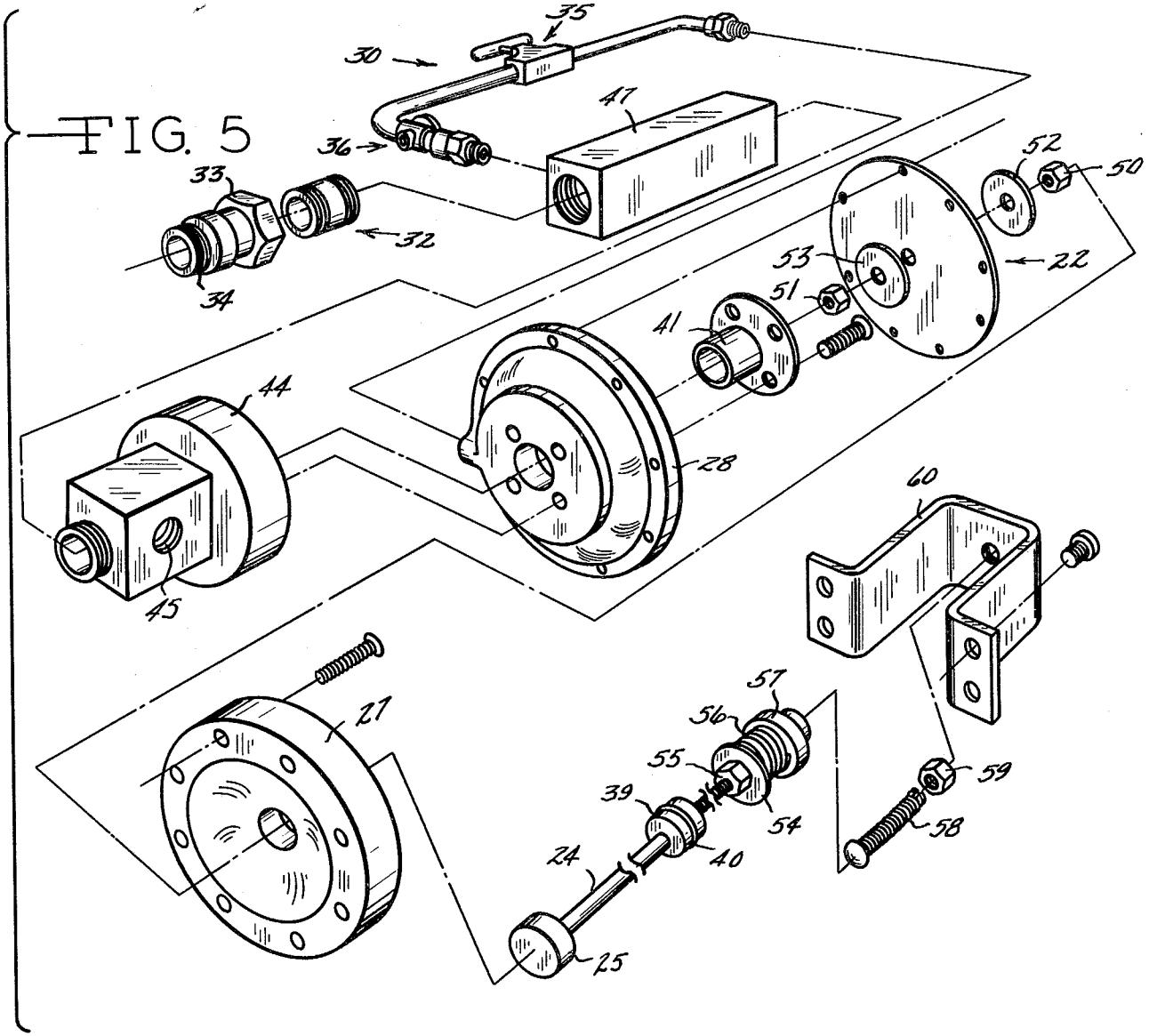
FIG. 5 is an exploded perspective of the conversion valve unit seen in FIG. 4 and indicating the simplicity of construction and suggestive of optional construction as where subassemblies may be combined and grouped.

FIG. 5 illustrates the assembly simplicity of the construction as described and in the best possible form for full testing and evaluation. The guide 42 is best seen in FIG. 3 assembled in the body section 47 and retained in position as by the retainer rings 43. The valve seat 23 is also located in the body element 47. Fasteners, as shown, provide connective means securing the sleeve 41 in the diaphragm body section 28 and secured to the section 44. Other suitable fastening means may be used as are well known in the art and the structural components may be combined in avoidance of the need for fasteners in some instances. Suitable packing seals and seal options well known in the art are available depending on the total pressure condition and the selected construction of the conversion unit 17.

Operation

In operation the conversion units thus described communicate high pressure line gas or fluid to internal combustion engines through the plug openings and to each cylinder using an automatic timing resulting from sensing the introduction of gas intermittently to each cylinder by the pressure condition consequent to the piston movement. There is a substantial saving of air since at the sensed condition the air above the piston is under pressure approaching the line pressure of the gas.

Engines performing under the described conversion require no major modification to adapt to the fluid drive system. When desired to reconvert, the owner simply replaces his spark or glow plugs with the new control units and couples the pressure media to his motor.

The operation is smooth and easily adapted to a selected pressure sensitivity threshold by increase in spring compression, by venting to atmosphere and by throttling the fluid or air flow to the linear actuator. Final adjustment achieves pressure attenuation by venting to atmosphere as desired.

Having thus described my invention and in particular a preferred embodiment thereof, those skilled in the art will perceive obvious improvements, modifications and adjustments and such improvements, modifications and adjustments which are within the skill of the art are intended to be included herein limited only by the scope of my hereinafter appended claims.

I claim:

1. A conversion unit replacing spark plugs of a piston engine for operating the engine on pressurized gas, the engine having a plurality of pistons reciprocable in a compression stroke and an exhaust stroke in respective cylinders, the unit comprising:

a source of compressed gas;

a housing having a flow passage therethrough;

an inlet port connected to said source and communicating pressurized gas from said source of pressurized gas into said housing;

a drive valve in said housing opening and closing to flow of said pressurized gas through said housing;

a sensor responsive to pressure down-stream of said drive valve and operably connected to said drive valve; and an outlet from said housing connected into the cylinder of a piston engine, above the piston, said outlet in communication with said sensor and said pressurized gas when said drive valve is open, said sensor causing said drive valve to open on the compression stroke of the pistons and to close on the exhaust stroke of said piston whereby the flow of said compressed gas is automatically timed.

2. A conversion unit for driving each cylinder of a piston engine with a pressurized compressible fluid, each cylinder comprising a piston reciprocable in a compression stroke and an exhaust stroke, the conversion unit comprising:

a source of compressed fluid;

a pressure sensing element;

a drive rod connected to said pressure sensing element;

a drive valve opened and closed repeatedly by said pressure sensing element acting upon said drive rod;

a conduit for compressed fluid in which said drive valve is interposed;

an outlet extension from said conduit and downstream of said drive valve connected to an engine cylinder above the piston; and a pressure sensing lead from said outlet extension and connected operably to said pressure sensing element for causing said pressure sensing element to open said drive valve on the compression stroke of the piston to communicate the source with the cylinder and for causing said pressure sensing element to close said drive valve on the exhaust stroke of the piston to block communication of the source with the cylinder; whereby the variations of pressure in the cylinder acting on said sensing element selectively activate said drive valve as said piston reciprocates in said cylinder.

3. A conversion unit attachable to a source of compressed fluid and to a cylinder of a piston type engine, a piston reciprocable in a compression stroke and an exhaust stroke in said cylinder, the conversion unit being attachable to the cylinder above the piston to communicate compressed fluid thereto from a source of compressed fluid, said fluid containing no combustible mixtures, said unit comprising:

a housing having an inlet and an outlet, said inlet connected to said source of compressed fluid and said outlet connected to said cylinder above said piston;

a drive valve in said housing intermediate said inlet and said outlet;

drive valve actuating means in said housing, said actuating means connected drivably to said drive valve; and a pressure sensor connected through a conduit to said outlet of said housing for acting on said drive valve actuating means in dependence of; pressure levels within said cylinder, said drive valve being opened by said pressure sensor to allow said fluid from said source to be communicated to said cylinder on the compression stroke of said piston and said drive valve being closed by said pressure sensor to block communication from said source on the exhaust stroke of said piston.

4. In the combination of the claim 3 in which the pressure sensor is a spring loaded piston connected to said drive valve actuating means and said drive valve actuating means is connected to said drive valve to actuate said drive valve in accord with selected pressure conditions in said cylinder.

5. In the combination of claim 3 in which said conduit includes a by-pass and said by-pass is provided with a valve to attenuate flow and pressure to said pressure sensor.

6. In the combination of claim 3 in which said pressure sensor opens and closes said drive valve in accord with selected pressure levels at said outlet.

* * * * *